US008197292B2

(12) United States Patent
Davis et al.

(10) Patent No.: US 8,197,292 B2
(45) Date of Patent: Jun. 12, 2012

(54) PROPULSION SYSTEM FOR MARINE VESSEL

(75) Inventors: Richard A. Davis, Mequon, WI (US); Niel M. Schueller, Fond du Lac, MI (US); Andrea Pellegrinetti, Trento (IT); Michele Zottele, Trento (IT)

(73) Assignees: ZF Friedrichshafen AG, Friedrichshafen (DE); Brunswick Corporation, Lake Forest, IL (US)

( * ) Notice: Subject to any disclaimer, the term of this patent is extended or adjusted under 35 U.S.C. 154(b) by 349 days.

(21) Appl. No.: 12/570,356

(22) Filed: Sep. 30, 2009

(65) Prior Publication Data

US 2010/0087107 A1 Apr. 8, 2010

Related U.S. Application Data

(60) Provisional application No. 61/102,157, filed on Oct. 2, 2008.

(51) Int. Cl.
*B63H 5/125* (2006.01)

(52) U.S. Cl. ..... 440/58; 440/81

(58) Field of Classification Search ..... 440/58, 440/81

See application file for complete search history.

(56) References Cited

U.S. PATENT DOCUMENTS

| | | | | |
|---|---|---|---|---|
| 5,246,392 | A * | 9/1993 | Johnston | 440/42 |
| 5,253,607 | A * | 10/1993 | Chen | 114/357 |
| 5,848,922 | A * | 12/1998 | Itima et al. | 440/66 |
| 6,599,159 | B1 * | 7/2003 | Hedlund et al. | 440/81 |
| 2007/0270053 | A1 * | 11/2007 | Arvidsson | 440/58 |

* cited by examiner

*Primary Examiner* — Stephen Avila
(74) *Attorney, Agent, or Firm* — Davis & Bujold, P.L.L.C.

(57) ABSTRACT

The invention concerns a marine vessel propulsion system that can be set into an opening of a boat's hull and which comprises a propulsion and steering unit (9) that can be rotated or swivelled about a vertical axis (z) and which is fixed to the hull by a securing mechanism (12) having a predetermined fracture point or level. It is proposed that a protective plate (13) is arranged on the boat's hull in the aft direction (opposite to the direction of travel F) and behind the propulsion and steering unit (9).

11 Claims, 1 Drawing Sheet

PROPULSION SYSTEM FOR MARINE VESSEL

FIELD OF THE INVENTION

The invention concerns a propulsion system for a marine vessel and a motor yacht.

BACKGROUND OF THE INVENTION

Known inboard boat propulsion systems have an underwater propulsion and steering unit which can be turned or swivelled about a vertical axis. Propulsion is produced by one or two propellers, whose rotation axis can be swivelled by means of the steering unit. Due to this ability of the propulsion vector to be swivelled, a boat-steering action is produced. With motor yachts in particular, the propulsion and steering unit determines the draught of the vessel and is, therefore, particularly exposed and endangered by contact with the bottom or by a collision with an underwater obstacle(s). When the propulsion and steering unit is attached to the hull, it is known to do this by means that comprise predetermined fracture points, for example in the form of calibrated screw-bolts, so that in the event of an impact of more than a predefined severity, the propulsion and steering unit will break free from the hull without causing a leak.

However, a problem can then arise if the wrenched off propulsion and steering unit is flung rearward, i.e., in the aft direction, and, at the same time, upward against the hull of the vessel. On impact with the sharp-edged propeller, The hull can be damaged and a leak produced by impact with a sharp-edge of the propeller or some other sharp edge of the propulsion and steering unit.

SUMMARY OF THE INVENTION

Wherefore, it is an object of the present invention to overcome the above mentioned shortcomings and drawbacks associated with the prior art.

The purpose of the present invention is to avoid such damage and leak-producing impacts in the hull by virtue of a propulsion system of the type described to begin with, fitted to a motor yacht.

According to the invention, a protective plate, which covers the outer surface of the vessel's hull and protects it against the effects of impact, particularly by the propeller of the vessel, is arranged in the flow direction behind the propulsion and steering unit. Preferably, this protective plate is made of stainless steel and is, therefore, particularly tough and resistant. Preferably, the protective or stainless steel plate is attached onto the hull, which as a rule consists of plastic. Thanks to the protective plate according to the invention, in the event that the propulsion and steering unit being dislodged or wrenched off, the hull is protected against damage and a leak-producing impact. To ensure this, the size of the protective plate is chosen such that the possible hull impact area is substantially covered.

According to an advantageous further development, the leading edge of the protective plate, in particular the area immediately adjacent to the opening in the hull, can be provided with a cladding, in particular a plastic section. This has the advantage that an eddy formation, caused by the outflow of cooling water from the drive engine, is avoided.

BRIEF DESCRIPTION OF THE DRAWINGS

An example embodiment of the invention is illustrated in the drawings and will be described in more detail below, while further features and/or advantages can be noted from the description and/or the drawings, which shows.

DETAILED DESCRIPTION OF THE INVENTION

Figure 1:
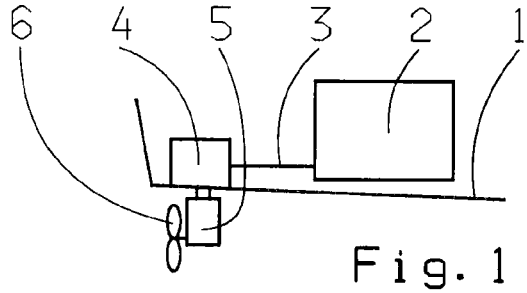
Fig. 1 (prior art)
FIG. 1 is a marine vessel propulsion system of the prior art.

FIG. 1 is a schematic illustration of a drive unit for a boat's hull 1, according to the prior art. A drive engine 2, a diesel engine for example, which is connected via a driveshaft 3 to a transmission 4 is arranged inside the boat's hull 1. A propulsion and steering unit 5 with a marine screw 6 (e.g., a propeller), which can swivel about a vertical axis (not shown), is arranged outside the hull 1, i.e., below the waterline. The rotation movement of the driveshaft 3 is thus transmitted, in each case, via an angle drive (bevel gear stage) to the transmission 4 and the propulsion and steering unit 5, and thence to the propeller 6. Thus, the vessel is steered by swivelling the propulsion vector produced by the propeller 6.

Figure 2:
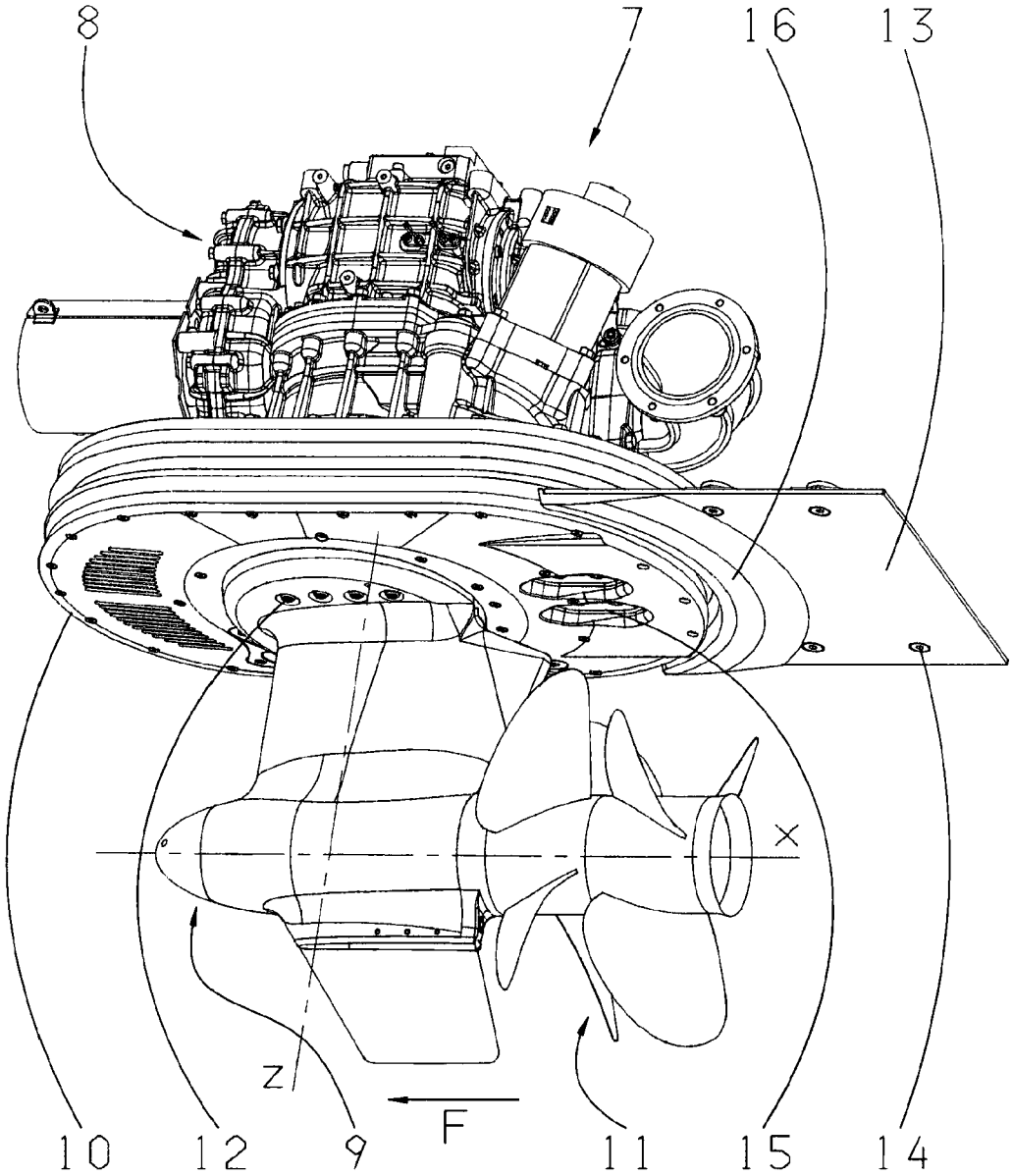
FIG. 2 is a marine vessel propulsion system with a protective plate according to the invention.

FIG. 2 shows a propulsion system 7 according to the invention, which has an inboard transmission aggregate 8 and an underwater propulsion and steering unit 9. The propulsion system 7 also comprises an approximately oval-shaped bottom-plate 10 which is located in an opening (not shown) of a boat's hull (also not shown) and is sealed relative to the hull in a conventional manner. A double screw 11, i.e., a double screw propeller, is arranged on the propulsion and steering unit 9 and can rotate about an axis x and be powered by a drive engine (not shown) arranged within the hull. This propulsion and steering unit 9 can be rotated or swivelled about a generally vertical axis z relative to the bottom-plate 10 and thus relative to the hull, the swivelling movement being produced by a steering device (not shown). The propulsion vector produced by the double screw propeller 11, can thus be swivelled so as to produce a steering effect for the vessel, comparable with the action of a rudder. The travel direction of the motor boat, i.e., its forward travel, is indicated by an arrow F, i.e., the arrangement of the double screw corresponds to that of a thrust-type propeller. The propulsion and steering unit 9 is attached to the hull by means of bolts which comprise predetermined fracture points 12. The predetermined fracture points 12 are provided in case an impact occurs on the propulsion and steering unit 9, for example, caused by running aground or by collision with an underwater obstacle. If the severity of the impact exceeds a predetermined limit, the bolts 12 break and the propulsion and steering unit 9, including the propeller 11, is separated from the hull.

In such a case, according to the invention, a protective plate 13 is arranged on the vessel's hull (not shown), also referred to just as 'the hull' for brevity. The protective plate 13, preferably made of stainless steel, abuts against the bottom-plate 10 in the aft direction, i.e., the direction opposite to the travel direction F, and is in contact with the outside of the hull. It can be fixed onto the hull by any suitable fixing means 14, such as screws for example. The length and width of the protective plate 13 are chosen such that the impact zone of a detached propulsion and steering unit 9 with an aft end of the hull is substantially covered. The width of the protective plate 13, also called the protective shield 13, is at least the same as the width of the bottom-plate 10. The length of the protective shield 13—in the aft direction—corresponds approximately to the draught of the propulsion and steering unit 9, i.e., the length that the propulsion and steering unit extends in the z direction. The outer skin or hull of the vessel is thus effectively protected by the protective shield 13 against damage due to collision by the propulsion and steering unit 9.

In the aft area of the bottom-plate 10, outlet openings 15 are provided for the outflow of drive engine cooling water. To avoid eddy formation in the leading edge area of the protective plate 13, a plastic cladding 16 is provided, which is directly adjacent to the outlet openings 15 and in contact with the underside of the protective plate 13. The plastic cladding 16 is preferably contoured so as to assist flow, in order to enable low-loss cooling water outflow.

Since certain changes may be made in the above described improved marine vessel propulsion system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Reference Numerals

1 boat hull
2 drive engine
3 driveshaft
4 transmission
5 propulsion and steering unit
6 propeller
7 marine vessel propulsion system
8 transmission aggregate
9 propulsion and steering unit
10 bottom-plate
11 double screw
12 bolts
13 protective plate
14 fixing means
15 cooling water outlet
16 plastic cladding
x screw axis
z vertical axis
F travel direction

The invention claimed is:

1. A marine vessel propulsion system which comprises a propulsion and steering unit (9) and a bottom plate (10), the bottom plate (10) comprises a forward end and an aft end, the bottom plate (10) is located in an opening of a hull of a boat and the bottom plate (10) is sealed relative to the hull, the propulsion and steering unit (9) is pivotally fixed to the hull via a mechanism (12) such that the propulsion and steering unit (9) pivots with respect to the bottom plate (10) and the hull about a vertical axis (z), a protective plate (13) is fixed to the hull of the boat such that a first edge of the protective plate (13) abuts only the aft end of the bottom plate (10) and a second edge of the protective plate (13), which is opposite the first edge, is spaced further from the vertical axis (z) than a remote end of the propulsion and steering unit (9), and the protective plate (13) protects the hull in the event that the propulsion and steering unit (9) becomes dislodged from the hull.

2. The marine vessel propulsion system according to claim 1, wherein the protective plate (13) is a stainless steel plate which only extends in the aft direction behind the propulsion and steering unit (9).

3. The marine vessel propulsion system according to claim 1, wherein the protective plate (13) is fixed onto the boat's hull by fixing means (14).

4. The marine vessel propulsion system according to claim 1, wherein a width of the protective plate (13) corresponds to a width of the opening.

5. The marine vessel propulsion system according to claim 1, wherein a length of the protective plate (13) substantially corresponds to a draught of the propulsion and steering unit (9).

6. The marine vessel propulsion system according to claim 1, wherein the propulsion and steering unit (9) includes a screw propeller, the protective plate (13) extends further, in the aft direction, from the vertical axis (z) than the propulsion and steering unit (9).

7. The marine vessel propulsion system according to claim 1, wherein the propulsion and steering unit (9) includes a double screw propeller that is located in the aft direction behind the propulsion and steering unit (9).

8. The marine vessel propulsion system according to claim 7, wherein the double screw propeller (11) is a thrust-type propeller arranged in a flow direction behind the vertical axis (z).

9. The marine vessel propulsion system according to claim 1, wherein the protective plate (13) has a flow-assisting cladding (16), in an area of adjacent a leading edge thereof, between the protective plate (13) and the mechanism (12).

10. The marine vessel propulsion system according to claim 9, wherein the cladding (16) is made of plastic.

11. The marine vessel propulsion system according to claim 1, wherein the hull (1) is made of plastic.

* * * * *